US006145129A

United States Patent [19]

Czekalla et al.

[11] Patent Number: 6,145,129

[45] Date of Patent: Nov. 14, 2000

[54] DEVICE TO ABSORB UNDERARM PERSPIRATION

[76] Inventors: Gerd Czekalla; Jill Czekalla, both of 16993 NW. 19th St., Pembroke Pines, Fla. 33028

[21] Appl. No.: 09/250,844

[22] Filed: Feb. 17, 1999

[51] Int. Cl.[7] ..... A41D 27/12; A41F 5/00

[52] U.S. Cl. ..... 2/53; 2/55; 2/44; 2/908; 602/18

[58] Field of Search ..... 2/53–55, 459, 2/460, 24, 44, 45, 16, 908, 911; 128/878, 881, 882; 602/26–27, 62, 20, 18

[56] References Cited

U.S. PATENT DOCUMENTS

| | | | |
|---|---|---|---|
| 264,462 | 9/1882 | Kleinert | 2/53 |
| 887,454 | 5/1908 | Basch . | |
| 1,122,113 | 12/1914 | Hausner . | |
| 1,137,452 | 4/1915 | Bienstock . | |
| 1,348,754 | 8/1920 | Shrader . | |
| 2,301,881 | 11/1942 | Kalenoff | 2/53 |
| 2,573,346 | 10/1951 | Madsen . | |
| 2,636,175 | 4/1953 | Hoffman . | |
| 2,687,527 | 8/1954 | Rendino . | |
| 3,885,247 | 5/1975 | Kost | 2/55 |
| 4,707,861 | 11/1987 | Lavoie et al. | 2/16 |
| 4,926,501 | 5/1990 | Goosen | 2/22 |
| 5,188,587 | 2/1993 | McGuire et al. | 602/20 |
| 5,245,707 | 9/1993 | Green . | |
| 5,946,737 | 9/1999 | Fleege | 2/455 |

*Primary Examiner*—John J. Calvert
*Assistant Examiner*—Tejash Patel
*Attorney, Agent, or Firm*—Tom Hamill, Jr.

[57] ABSTRACT

A device to absorb underarm perspiration is provided. The device includes a central body with an absorbent pad disposed thereon. Extending from the upper portion of the central body is a first pair of arms, which include a right and left terminus. Located atop the right and left terminus of the first pair of arms is a first fastening means designed to hold the absorbent pad directly on the underarm by looping generally about the deltoid muscle of the arm and connecting the right arm to the left arm. Extending from the middle portion of the central body is a second pair of arms, which include a right and a left terminus. Located atop the right and left terminus of the second pair of arms is a second fastening means designed to additionally secure the absorbent pad directly on the underarm by affixing the right and left arms of the second pair of arms to the trunk of the user. Extending from the lower portion of the central body is a third pair of arms, which include a right and a left terminus. Located atop the right and left terminus of the third pair of arms is a third fastening means designed to further additionally secure the absorbent pad directly on the underarm. This is accomplished by affixing the right and left arms of the third pair of arms to the trunk of the user. The device is attached so that the absorbent pad is firmly affixed to the underarm, and will absorb perspiration secreted therefrom.

10 Claims, 3 Drawing Sheets

DEVICE TO ABSORB UNDERARM PERSPIRATION

BACKGROUND OF THE INVENTION

1. Field of the Invention

The present invention relates generally to hygienic devices, and more particularly, to an absorbent pad to be affixed to each underarm especially adapted to absorb perspiration secreted therefrom.

2. Description of the Prior Art

People perspire through the action of the Sudoriferous gland located beneath the skin. The gland manufactures and secretes sweat which contains water, salts, urea, uric acid, amino acids, ammonia, sugar, lactic acid, and ascorbic acid. This secreted sweat then travels through an excretory duct which extends through the dermis and epidermis where it terminates at a sweat pore on the surface of the epidermis.

Generally speaking, sweating is used by the body as a thermal regulation device, as well as a means to eliminate toxins. During periods of high activity, stress or nervousness, sweating increases, especially under the arms. Some people tend to sweat in greater quantities than others as well. This excess perspiration will tend to dampen clothing proximal the underarm, in some cases causing unsightly damp regions thereon. In a hygiene and media conscious society such as that present in the United States, such damp areas are undesirable.

Attempts have been made to solve the aforementioned problem. Dress shields, perspiration attenuators, and other methods have been employed in an effort to control the problem. U.S. Pat. No. 887,454 in one such device. A strap loops about the shoulder portion of the arm, affixing a multi-leafed shield to the underarm area. The strap is centrally located with respect to the leaves, and holds the device in place. This device is different from the instant invention as it does not include multiple attachment points, nor does it include a pad disposed above a body portion.

Another such device which is affixed to the underarm to absorb perspiration is U.S. Pat. No. 3,885,247. This device includes a pad and a backing which is adhered proximal the underarm by adhesive means. This device is substantially structurally different from the instant invention as it does not have a plurality of elongated arms which affix to different locations on the body to secure the pad proximal the underarm.

Other devices are known as well and as such have been provided to the US Patent Office for consideration.

Thus, while the foregoing body of prior art indicates it to be well known to use devices to absorb sweat in the axilla, the provision of a mechanically simple, potentially disposable, easy to use device is not contemplated. The prior art includes many complex devices which are structurally impractical. The foregoing disadvantages are overcome by the unique simple design of present invention as will be made apparent from the following description thereof. Other advantages of the present invention over the prior art also will be rendered evident.

SUMMARY OF THE INVENTION

To achieve the foregoing and other advantages, the present invention, briefly described, provides a device to absorb underarm perspiration. The device includes a central body with an absorbent pad disposed thereon. Extending from the upper portion of the central body is a first pair of arms, which include a right and left terminus. Located atop the right and left terminus of the first pair of arms is a first fastening means designed to hold the absorbent pad directly on the underarm by looping generally about the deltoid muscle of the arm and connecting the right arm to the left arm. Extending from the middle portion of the central body is a second pair of arms, which include a right and a left terminus. Located atop the right and left terminus of the second pair of arms is a second fastening means designed to additionally secure the absorbent pad directly on the underarm by affixing the right and left arms of the second pair of arms to the thorax or trunk of the user. Extending from the lower portion of the central body is a third pair of arms, which include a right and a left terminus. Located atop the right and left terminus of the third pair of arms is a third fastening means designed to further additionally secure the absorbent pad directly on the underarm. This is accomplished by affixing the right and left arms of the third pair of arms to the thorax or trunk of the user. The six legs are attached in such a way that the absorbent pad is firmly affixed to the underarm, and will absorb perspiration secreted therefrom.

The first pair of arms fastening means may be adhesive tape, hook and loop fasteners or adhesive. The first pair of arms are designed to loop generally about the deltoid muscle of the arm and secure themselves together. The second pair of arms fastening means may be adhesive tape, hook and loop fasteners or adhesive. The second pair of arms may be attached to the trunk, or in an alternative embodiment, be provided to be of sufficient length to loop about the neck of the user, and secure themselves together. The third pair of arms may also be attached to the trunk, or in an another alternative embodiment, also be provided to be of sufficient length to loop about trunk (torso) of the user, and cooperatively secure themselves to the third pair of arms located on a second device, which is employed under the second underarm.

The central body and plurality of arms may include material with elastic properties in order to permit stretching. Further, the central body may include material which is hydrophobic.

The absorbent pad may be removable and replaceable once soiled. The absorbent pad may be held in place by the action of the central body or may be adapted to be secured thereto. This may be done by any of a variety of conventional methods, including, but not limited to, adhesives, tapes, hook and loop attachments, and other removable connection means. The absorbent pad may also have deodorant or other moisture absorbing materials entrained therein. The materials which come into contact with the skin may include materials which do not evoke an allergic reaction in most people. Additionally, it has been considered that the absorbent pad may have other materials entrained therein for different applications. Hair removal compounds may be entrained to permit the pad to be used to remove underarm hair. Further, medicaments such as antibiotics or antibacterial-viral compounds may be entrained on the pad to permit healing of an injury or a surgery in the underarm region.

Any of a variety of absorbent materials may be employed in the construction of the absorbent pad. Additionally, any elastic-fabric materials or composites which have satisfactory material and elastic properties may be employed in the construction of the central body and the plurality of arms.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining at least the preferred embodiments of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a device to absorb underarm perspiration which includes a central body with an absorbent pad disposed thereon.

It is therefore an object of the present invention to provide a device to absorb underarm perspiration which includes a first, second and third pair of arms depending from the central body.

It is therefore an object of the present invention to provide a device to absorb underarm perspiration where each of the six arms includes means to affix the arms to the body of the user, thereby securing the absorbent pad firmly beneath the underarm.

It is a further objective of the present invention to provide a device to absorb underarm perspiration which is of a mechanically simple construction, and which will be flexible in material, as to allow snug fit to the underarm through the full range of arm movement.

It is a further objective of the present invention to provide a device to absorb underarm perspiration which is easy to apply and remove from the underarm.

It is another object of the present invention to provide a device to absorb underarm perspiration which may be easily and efficiently manufactured and marketed.

It is a further objective of the present invention to provide a device to absorb underarm perspiration which is of durable and reliable construction.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein.

DESCRIPTION OF THE PREFERRED EMBODIMENT

With reference now to the drawings, a perspiration absorbing device embodying the principles and concepts of the present invention will be described.

Figure 1:
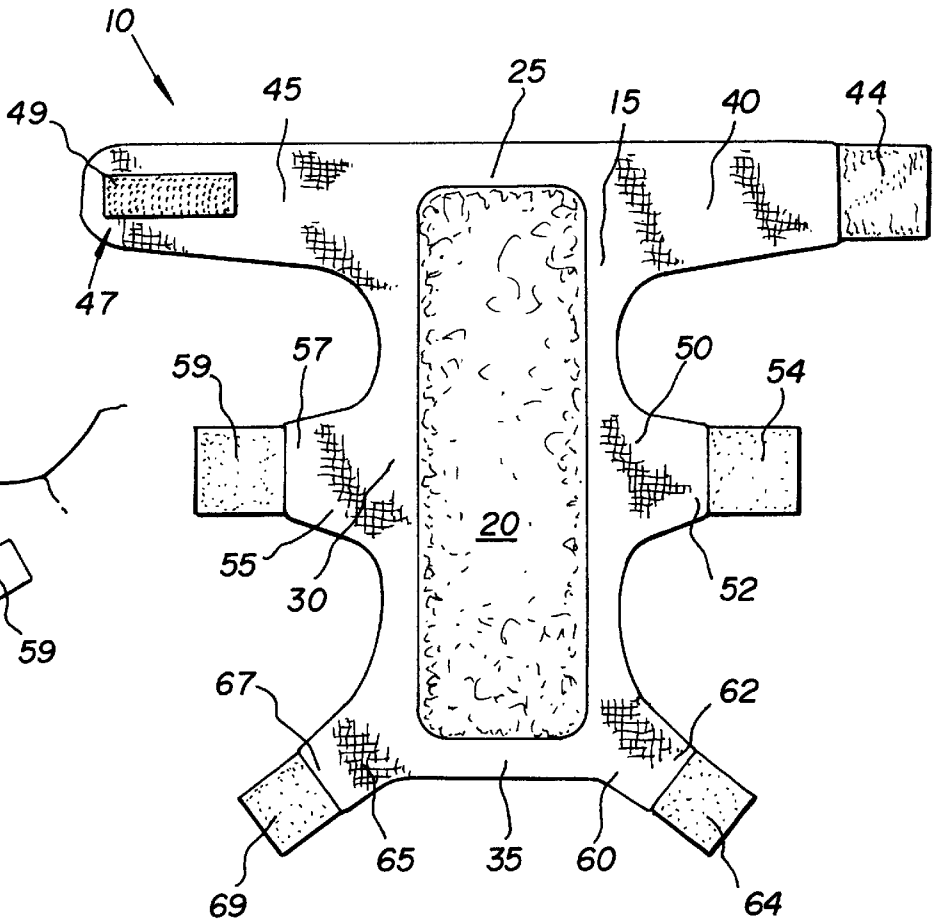
FIG. 1 is a view showing the first preferred embodiment of the perspiration absorbing device of the invention.
Figure 2:
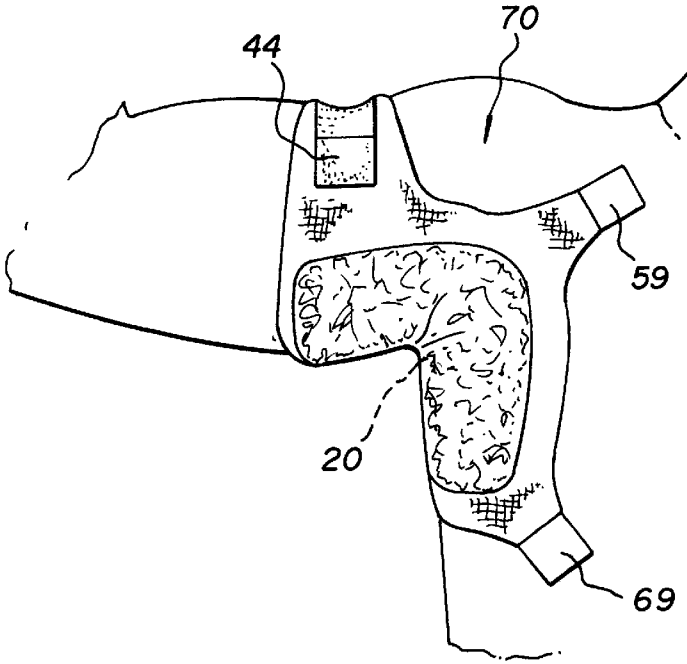
FIG. 2 is a view showing the first preferred embodiment of the perspiration absorbing device of the invention attached to the underarm of the user.

Turning initially to FIGS. 1 & 2, there is shown a first exemplary embodiment of the perspiration absorbing device of the invention generally designated by reference numeral 10. In its preferred form, perspiration absorbing device 10 comprises generally a central body 15 with a absorbent pad 20 disposed thereon. The central body 15 includes an upper portion 25, a middle portion 30 and a lower portion 35. Extending from the upper portion 25 is a first pair of arms, which includes an upper portion right arm 40 and an upper portion left arm 45. Extending from the middle portion 30 is a second pair of arms, which includes a middle portion right arm 50 and a middle portion left arm 55. Extending from the lower portion 35 is a third pair of arms, which includes a lower portion right arm 60 and a lower portion left arm 65.

The upper portion right arm 40 includes an upper portion right arm terminus or distal portion 42. Affixed to the upper portion right arm terminus 42 is an upper portion right arm connection means 44. The upper portion left arm 45 includes an upper portion left arm terminus or distal portion 47. Affixed to the upper portion left arm terminus 47 is an upper portion left arm connection means 49.

The upper portion right arm 40 and the upper portion left arm 45 are adapted to loop generally about the deltoid muscle of the arm 70 of the user where the upper portion right arm connection means 44 and the upper portion left arm connection means 49 may cooperatively inter-engage securing the upper portion right arm 40 to the upper portion left arm 45. This may be accomplished by hook and loop fasteners, adhesive tape, or other mechanical fasteners such as male and female clips and the like.

The middle portion right arm 50 includes a middle portion right arm terminus or distal portion 52. Affixed to the middle portion right arm terminus 52 is a middle portion right arm connection means 54. The middle portion left arm 55 includes a middle portion left arm terminus or distal portion 57. Affixed to the middle portion left arm terminus 57 is a middle portion left arm connection means 59.

The middle portion right arm 50 is adapted to be affixed to either the back upper torso of the user or the front upper torso of the user, depending if the device is affixed to the right or left axilla. This is accomplished by the middle portion right arm connection means 54 being adhesively attached to the user. This will generally be accomplished by the middle portion right arm connection means 54 being composed of adhesive tape or an adhesive tab, with or without a cover strip which will be peeled off prior to attachment.

The middle portion left arm 55 is adapted to be affixed to either the back upper torso of the user or the front upper torso of the user, depending if the device is affixed to the right or left axilla. This is accomplished by the middle portion left arm connection means 59 being adhesively attached to the user. This will generally be accomplished by the middle portion left arm connection means 59 being composed of adhesive tape or an adhesive tab, with or without a cover strip which will be peeled off prior to attachment.

The lower portion right arm 60 includes a lower portion right arm terminus or distal portion 62. Affixed to the lower portion right arm terminus 62 is a lower portion right arm connection means 64. The lower portion left arm 65 includes a lower portion left arm terminus or distal portion 67. Affixed to the lower portion left arm terminus 67 is a lower portion left arm connection means 69.

The lower portion right arm 60 is adapted to be affixed to either the back upper torso of the user or the front upper torso of the user, below the second pair of arms, depending if the device is affixed to the right or left axilla. This is accomplished by the lower portion right arm connection means 64 being adhesively attached to the user. This will generally be accomplished by the lower portion right arm connection means 64 being composed of adhesive tape or an adhesive tab, with or without a cover strip which will be peeled off prior to attachment.

The lower portion left arm 65 is adapted to be affixed to either the back upper torso of the user or the front upper torso of the user, below the second pair or arms, depending if the device is affixed to the right or left axilla. This is accomplished by the lower portion left arm connection means 69 being adhesively attached to the user. This will generally be accomplished by the lower portion left arm connection means 69 being composed of adhesive tape or an adhesive tab, with or without a cover strip which will be peeled off prior to attachment.

Figure 4:
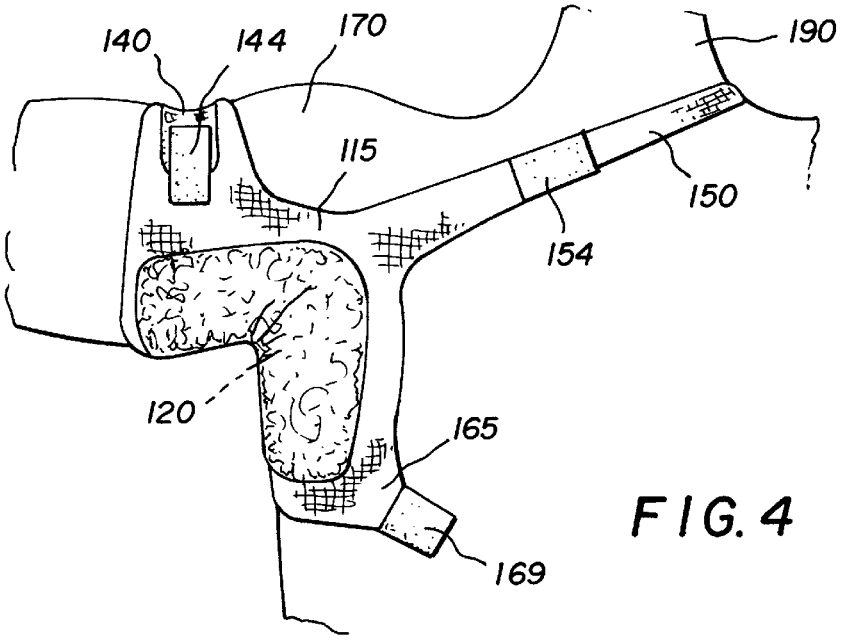
FIG. 4 is a view showing the second preferred embodiment of the perspiration absorbing device of the invention attached to the underarm of the user.
Figure 3:
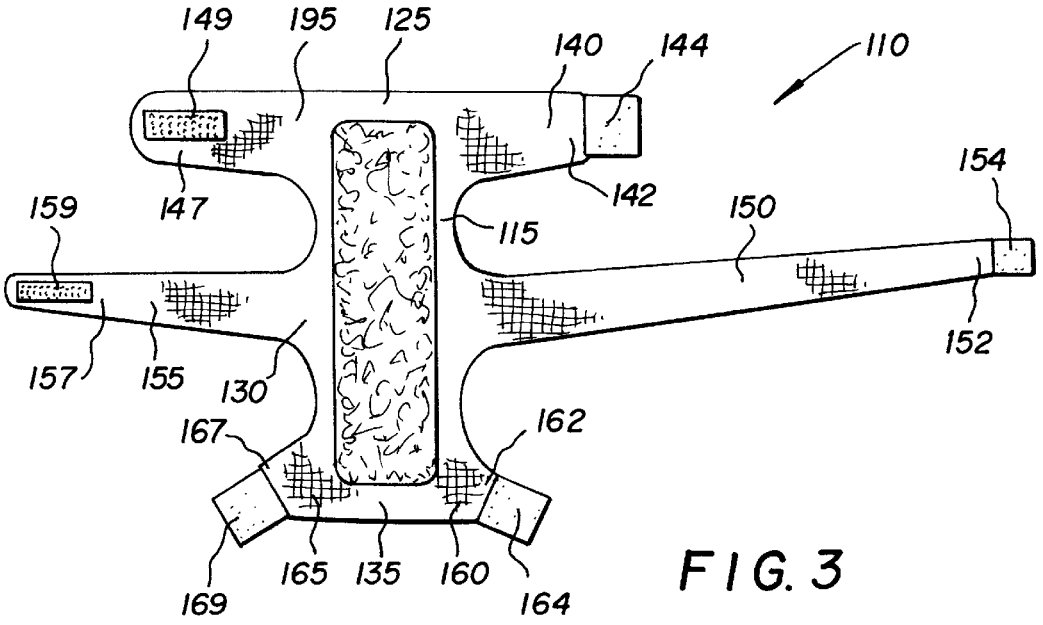
FIG. 3 is a view showing the second preferred embodiment of the perspiration absorbing device of the invention.

Turning now to FIGS. 3 & 4, there is shown a second exemplary embodiment of the perspiration absorbing device of the invention generally designated by reference numeral 110. In its preferred form, perspiration absorbing device 110 comprises generally a central body 115 with a absorbent pad 120 disposed thereon. The central body 115 includes an upper portion 125, a middle portion 130 and a lower portion 135. Extending from the upper portion 125 is a first pair of arms, which includes an upper portion right arm 140 and an upper portion left arm 145. Extending from the middle portion 130 is a second pair of arms, which includes a middle portion right arm 150 and a middle portion left arm 155. Extending from the lower portion 135 is a third pair of arms, which includes a lower portion right arm 160 and a lower portion left arm 165.

The upper portion right arm 140 includes an upper portion right arm terminus or distal portion 142. Affixed to the upper portion right arm terminus 142 is an upper portion right arm connection means 144. The upper portion left arm 145 includes an upper portion left arm terminus or distal portion 147. Affixed to the upper portion left arm terminus 147 is an upper portion left arm connection means 149.

The upper portion right arm 140 and the upper portion left arm 145 are adapted to loop about the generally about the deltoid muscle of the arm 170 of the user where the upper portion right arm connection means 144 and the upper portion left arm connection means 149 may cooperatively inter-engage securing the upper portion right arm 140 to the upper portion left arm 145. This may be accomplished by hook and loop fasteners, adhesive tape, or other mechanical fasteners such as male and female clips or the like.

The middle portion right arm 150 is elongated as it is adapted to loop about the neck 190 of the user. The middle portion right arm 150 includes a middle portion right arm terminus or distal portion 152. Affixed to the middle portion right arm terminus 152 is a middle portion right arm connection means 154. The middle portion left arm 155 is also generally elongated, and may be longer than the upper portion left arm 145. The middle portion left arm 155 includes a middle portion left arm terminus or distal portion 157. Affixed to the middle portion left arm terminus 157 is a middle portion left arm connection means 159.

The middle portion right arm 150 and the middle portion left arm 155 are adapted to loop about the generally about the neck 190 of the user where the middle portion right arm connection means 154 and the middle portion left arm connection means 159 may cooperatively inter-engage securing the middle portion right arm 150 to the middle portion left arm 155. The connection of the middle portion right arm connection means 154 to the middle portion left arm connection means 159 may generally be made on the front upper torso of the user. This may be accomplished by hook and loop fasteners, adhesive tape, or other mechanical fasteners such as male and female clips and the like. If the middle pair of connection means are chosen to be composed of adhesive tape or an adhesive tab, it may be provided with or without a cover strip which will be peeled off prior to attachment.

The lower portion right arm 160 includes a lower portion right arm terminus or distal portion 162. Affixed to the lower portion right arm terminus 162 is a lower portion right arm connection means 164. The lower portion left arm 165 includes a lower portion left arm terminus or distal portion 167. Affixed to the lower portion left arm terminus 167 is a lower portion left arm connection means 169.

The lower portion right arm 160 is adapted to be affixed to either the back upper torso of the user or the front upper torso of the user, below the second pair of arms, depending if the device is affixed to the right or left axilla. This is accomplished by the lower portion right arm connection means 164 being adhesively attached to the user. This will generally be accomplished by the lower portion right arm connection means 164 being composed of adhesive tape or an adhesive tab, with or without a cover strip which will be peeled off prior to attachment.

The lower portion left arm 165 is adapted to be affixed to either the back upper torso of the user or the front upper torso of the user, below the second pair of arms, depending if the device is affixed to the right or left axilla. This is accomplished by the lower portion left arm connection means 169 being adhesively attached to the user. This will generally be accomplished by the lower portion left arm connection means 169 being composed of adhesive tape or an adhesive tab, with or without a cover strip which will be peeled off prior to attachment.

Figure 6:
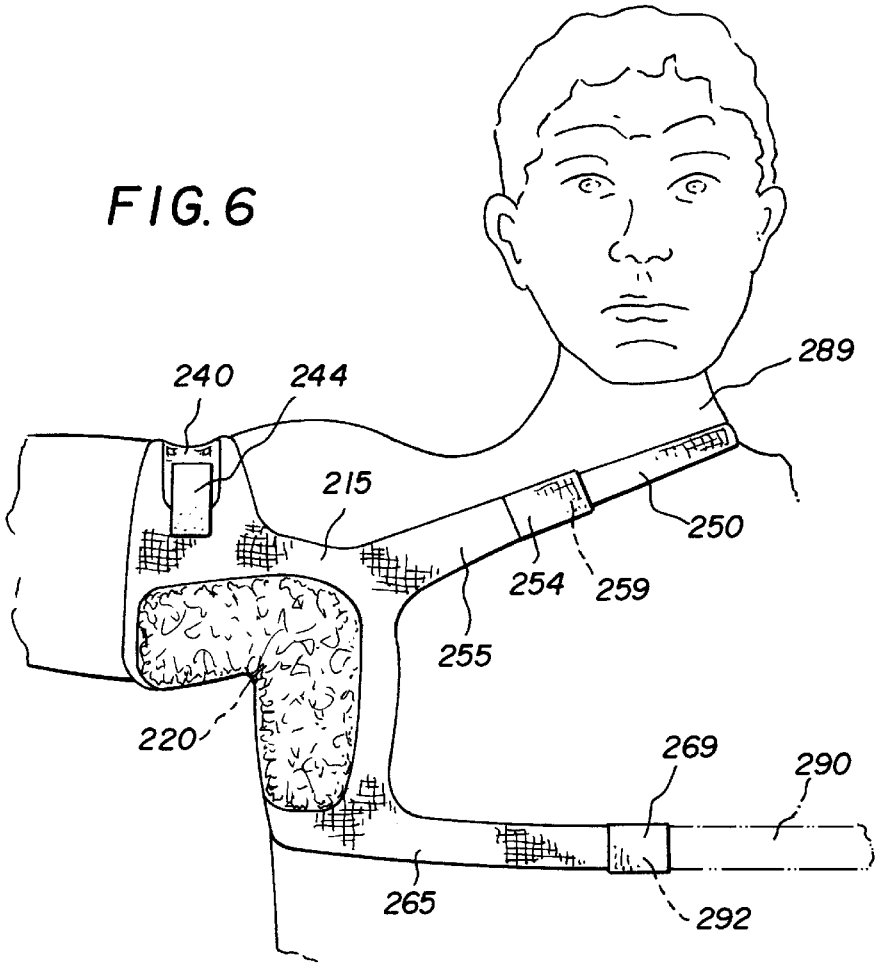
FIG. 6 is a view showing the third preferred embodiment of the perspiration absorbing device of the invention attached to the underarm of the user.
Figure 5:
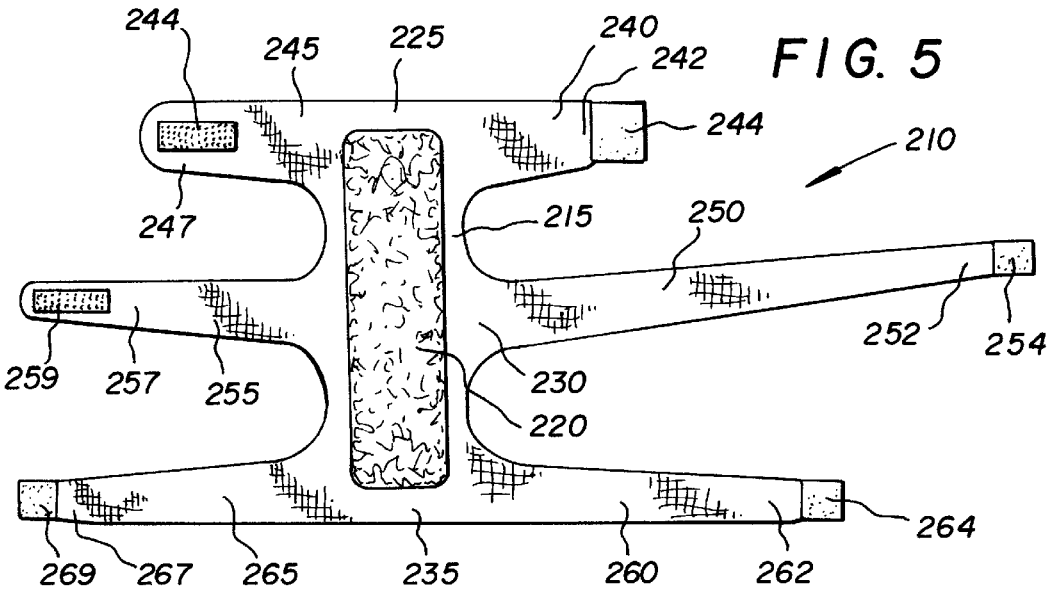
FIG. 5 is a view showing the third preferred embodiment of the perspiration absorbing device of the invention.

Turning now to FIGS. 5 & 6, there is shown a third exemplary embodiment of the perspiration absorbing device of the invention generally designated by reference numeral 210. In its preferred form, perspiration absorbing device 210 comprises generally a central body 215 with a absorbent pad 220 disposed thereon. The central body 215 includes an upper portion 225, a middle portion 230 and a lower portion 235. Extending from the upper portion 225 is a first pair of arms, which includes an upper portion right arm 240 and an upper portion left arm 245. Extending from the middle portion 230 is a second pair of arms, which includes a middle portion right arm 250 and a middle portion left arm 255. Extending from the lower portion 235 is a third pair of arms, which includes a lower portion right arm 260 and a lower portion left arm 265.

The upper portion right arm 240 includes an upper portion right arm terminus or distal portion 242. Affixed to the upper portion right arm terminus 242 is an upper portion right arm connection means 244. The upper portion left arm 245 includes an upper portion left arm terminus or distal portion 247. Affixed to the upper portion left arm terminus 247 is an upper portion left arm connection means 249.

The upper portion right arm 240 and the upper portion left arm 245 are adapted to loop generally about the deltoid muscle of the arm 270 of the user where the upper portion right arm connection means 244 and the upper portion left arm connection means 249 may cooperatively inter-engage securing the upper portion right arm 240 to the upper portion left arm 245. This may be accomplished by hook and loop fasteners, adhesive tape, or other mechanical fasteners such as male and female clips and the like.

The middle portion right arm 250 is elongated as it is adapted to loop about the neck 289 of the user. The middle portion right arm 250 includes a middle portion right arm terminus or distal portion 252. Affixed to the middle portion right arm terminus 252 is a middle portion right arm connection means 254. The middle portion left arm 255 is also generally elongated, and may be longer than the upper portion left arm 245. The middle portion left arm 255 includes a middle portion left arm terminus or distal portion 257. Affixed to the middle portion left arm terminus 257 is a middle portion left arm connection means 259.

The middle portion right arm 250 and the middle portion left arm 255 are adapted to loop about the generally about the neck 290 of the user where the middle portion right arm connection means 254 and the middle portion left arm connection means 259 may cooperatively inter-engage securing the upper portion right arm 250 to the middle portion left arm 255. The connection of the middle portion right arm connection means 254 to the middle portion left arm connection means 259 may generally be made on the front upper torso of the user. This may be accomplished by hook and loop fasteners, adhesive tape, or other mechanical fasteners such as male and female clips and the like. If the middle pair of connection means are chosen to be composed of adhesive tape or an adhesive tab, it may be provided with or without a cover strip which will be peeled off prior to attachment.

The lower portion right arm 260 includes a lower portion right arm terminus or distal portion 262. Affixed to the lower portion right arm terminus 262 is a lower portion right arm connection means 264. The lower portion left arm 265 includes a lower portion left arm terminus or distal portion 267. Affixed to the lower portion left arm terminus 267 is a lower portion left arm connection means 269.

The lower portion right arm 260 is adapted to be affixed to one of the second lower portion arms from a second perspiration absorbing device which is affixed to the other or second armpit. This is accomplished by the lower portion right arm attachment means 264 connecting with one of the lower portion attachment means depending from the second perspiration absorbing device which is affixed to the other armpit.

The lower portion left arm 265 is adapted to be affixed to one of the second lower portion arms 290 from a second perspiration absorbing device which is affixed to the other or second armpit. This is accomplished by the lower portion right arm attachment means 269 connecting with one of the lower portion attachment means 292 depending from the second perspiration absorbing device which is affixed to the other armpit.

The lower portion right arm attachment means 264, the lower portion left arm attachment means 269, and both the lower portion attachment means from the perspiration absorbing device affixed to the other armpit may include, but is not limited to, hook and loop fasteners, adhesive tape and other mechanical fasteners or the like. Adhesive tape may include peel off backing which must be removed before attachment.

The central body (15, 115, 215) and plurality of arms may include material with elastic properties in order to permit stretching. Further, the central body may include material which is hydrophobic.

The absorbent pad (20, 120, 220) may be removable and replaceable once soiled. The absorbent pad may be held in place by the action of the central body or may be adapted to be secured thereto. This may be done by any of a variety of conventional methods, including, but not limited to, adhesives, tapes, hook and loop attachments, and other removable connection means. Additionally, the absorbent pad may be permanently secured by heat welding, adhesive layer, needle punching, or any other method of attaching a first layer to a second layer in a permanent fashion. In this way the perspiration absorbing device will be disposable after use. The absorbent pad may also have deodorant or other moisture absorbing materials entrained therein. The materials which come into contact with the skin may include materials which do not evoke an allergic reaction in most people.

Any of a variety of absorbent materials may be employed in the construction of the absorbent pad. Additionally, any elastic-fabric materials or composites which has satisfactory material and elastic properties may be employed in the construction of the central body and the plurality of arms.

It is apparent from the above that the present invention accomplishes all of the objectives set forth by providing a device to absorb underarm perspiration which includes a central body with an absorbent pad disposed thereon, which includes a first, second and third pair of arms depending from the central body.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed is:

1. A device to be affixed to the underarm area of a person to absorb perspiration comprising:

a body section adapted to conform with the underarm of a user having an absorbent pad removably affixed thereto, said body section further comprising an upper portion, a middle portion, and a lower portion;

a first pair of arms, said first pair of arms being located on said upper portion of said body section, said first pair of arms comprising a first right arm extending from a right side of said body portion and a first left arm extending from a left side of said body portion, said first right arm having a first right arm distal portion and said first left arm having a first left arm distal portion, and where said first pair of arms includes interengaging fastening means located on both said first right arm distal portion and said first left arm distal portion such that said first pair of arms are looped generally about the deltoid muscle of a user and engaged with said first pair of arms interengaging fastening means to hold said body section and said removably attached absorbent pad against the underarm of a user;

a second pair of arms located on said middle portion of said body section, said second pair of arms comprising a second right arm extending from a right side of said body portion and a second left arm extending from a left side of said body portion, said second right arm having a second right arm distal portion and said second left arm having a second left arm distal portion, and where said second pair of arms includes adhesive attachment means located on both said second right arm distal portion and said second left arm distal portion such that said second pair of arms are adhesively attachable to the anterior and posterior upper scapular portion of the users torso to hold said body section and said removably attached absorbent pad against the underarm of the user;

a third pair of arms located on said lower portion of said body section, said third pair of arms comprising a third right arm extending from a right side of said body portion and a third left arm extending from a left side of said body portion, said third right arm having a third right arm distal portion and said third left arm having a third left arm distal portion, and where said third pair of arms includes adhesive attachment means located on both said third right arm distal portion and said third left arm distal portion such that said third pair of arms are adhesively attachable to the anterior and posterior lower scapular portion of the users torso to hold said body section and said removably attached absorbent pad against the underarm of the user; whereby said removably attached absorbent pad is secured to the underarm of the user to absorb excess perspiration.

2. A device as claimed in claim 1, wherein said absorbent pad includes a deodorant entrained therein.

3. A device to be affixed to the underarm area of a person to absorb perspiration comprising:

a body section adapted to conform with the underarm of a user having an absorbent pad removably affixed thereto, said body section further comprising an upper portion, a middle portion, and a lower portion;

a first pair of arms, said first pair of arms being located on said upper portion of said body section, said first pair of arms comprising a first right arm extending from a right side of said body portion and a first left arm extending from a left side of said body portion, said first right arm having a first right arm distal portion and said first left arm having a first left arm distal portion, and where said first pair of arms includes interengaging fastening means located on both said first right arm distal portion and said first left arm distal portion such that said first pair of arms are looped generally about the deltoid muscle of a user and engaged with said first pair of arms interengaging fastening means to hold said body section and said removably attached absorbent pad against the underarm of a user;

a second pair of arms located on said middle portion of said body section, said second pair of arms being substantially longer than said first pair of arms, said second pair of arms comprising a second right arm extending from a right side of said body portion and a second left arm extending from a left side of said body portion, said second right arm having a second right arm distal portion and said second left arm having a second left arm distal portion, and where said second pair of arms includes interengaging fastening means located on both said second right arm distal portion and said second left arm distal portion such that said second pair of arms are looped about the neck of the user and are attached by said interengaging fastening means on the front torso of the user to hold said body section and said removably attached absorbent pad against the underarm of the user;

a third pair of arms located on said lower portion of said body section, said third pair of arms comprising a third right arm extending from a right side of said body portion and a third left arm extending from a left side of said body portion, said third right arm having a third right arm distal portion and said third left arm having a third left arm distal portion, and where said third pair of arms includes adhesive attachment means located on both said third right arm distal portion and said third left arm distal portion such that said third pair of arms are adhesively attachable to the anterior and posterior lower scapular portion of the users torso to hold said body section and said removably attached absorbent pad against the underarm of the user; whereby said removably attached absorbent pad is secured to the underarm of the user to absorb excess perspiration.

4. A device as claimed in claim 3, wherein said second pair of arms are made of an elastic material.

5. A device as claimed in claim 4, wherein said interengaging fastening means located on said second pair of arms are interengaging fastening means selected from the group consisting of hook and loop fasteners, adhesive tape, and adhesive.

6. A device as claimed in claim 3, wherein said absorbent pad includes a deodorant entrained therein.

7. A device to be affixed to the underarm area of a person to absorb perspiritation comprising:

a body section adapted to conform with the underarm of a user having an absorbent pad removably affixed thereto, said body section further comprising an upper portion, a middle portion, and a lower portion;

a first pair of arms, said first pair of arms being located on said upper portion of said body section, said first pair of arms comprising a first right arm extending from a right side of said body portion and a first left arm extending from a left side of said body portion, said first right arm having a first right arm distal portion and said first left arm having a first left arm distal portion, and where said first pair of arms includes interengaging fastening means located on both said first right arm distal portion and said first left arm distal portion such that said first pair of arms are looped generally about the deltoid muscle of a user and engaged with said first pair of arms interengaging fastening means to hold said body section and said removably attached absorbent pad against the underarm of a user;

a second pair of arms located on said middle portion of said body section, said second pair of arms being substantially longer than said first pair of arms, said second pair of arms comprising a second right arm extending from a right side of said body portion and a second left arm extending from a left side of said body portion, said second right arm having a second right arm distal portion and said second left arm having a second left arm distal portion, and where said second pair of arms includes interengaging fastening means located on both said second right arm distal portion and said second left arm distal portion such that said second pair of arms are looped about the neck of the user and are attached by said interengaging fastening means on the front torso of the user to hold said body section and said removably attached absorbent pad against the underarm of the user;

a third pair of arms located on said lower portion of said body section, said third pair of arms being substantially longer than said first pair of arms, said third pair of arms comprising a third right arm extending from a right side of said body portion and a third left arm extending from a left side of said body portion, said third right arm having a third right arm distal portion and said third left arm having a third left arm distal portion, and where said third pair of arms include interengaging fastening means located on both said third right arm distal portion and said third left arm distal portion such that said third pair of arms are looped about the torso of the user to hold said body section and said removably attached absorbent pad against the underarm of the user; whereby said removably attached absorbent pad is secured to the underarm of the user to absorb excess perspiration.

8. A device as claimed in claim 7, wherein said second pair of arms and said third pair of arms are made of an elastic material.

9. A device as claimed in claim 8, wherein said interengaging fastening means located on said second pair of arms and said third pair of arms are interengaging fastening means selected from the group consisting of hook and loop fasteners, adhesive tape, and adhesive.

10. A device as claimed in claim 7, wherein said absorbent pad includes a deodorant entrained therein.

* * * * *